US005369394A

United States Patent [19]

Quirk et al.

[11] Patent Number: 5,369,394

[45] Date of Patent: Nov. 29, 1994

[54] MAGNETIC SECURITY SYSTEM RESPONSIVE TO PREDETERMINED PERSONS

[75] Inventors: Brian J. Quirk, Lockport; Robert R. Bennett, Decatur, both of Ill.

[73] Assignee: Wanderer Saf-T-Lok, Chicago, Ill.

[21] Appl. No.: 80,289

[22] Filed: Jun. 21, 1993

Related U.S. Application Data

[63] Continuation-in-part of Ser. No. 871,057, Apr. 20, 1993, abandoned.

[51] Int. Cl.[5] ..... G08B 13/22

[52] U.S. Cl. ..... 340/551; 49/31; 340/573; 340/825.31; 361/170

[58] Field of Search ..... 340/551, 573, 825.31; 361/170; 49/31

[56] References Cited

U.S. PATENT DOCUMENTS

| | | | |
|---|---|---|---|
| 3,564,501 | 2/1971 | Flook, Jr. | 340/825.31 |
| 4,555,696 | 11/1985 | Brown | 340/551 |
| 4,682,155 | 9/1987 | Shirky | 340/573 |
| 4,870,391 | 9/1989 | Cooper | 340/551 |
| 4,899,134 | 2/1990 | Wheeless, Jr. | 340/551 |
| 5,126,720 | 6/1992 | Zhou et al. | 340/551 |

*Primary Examiner*—Glenn Swann
*Attorney, Agent, or Firm*—Joseph E. Papin

[57] ABSTRACT

A security system operates in response to an attempted egress through a door by a preselected person. The magnetic field of a permanent magnet is passed in a preselected spatial relation which respected a current generating device to generate a current upon the attempted egress through the door by the preselected person carrying the permanent magnet, and a security device is energized to lock the door upon the establishment of the generated current. A method of operating a security system is also disclosed.

13 Claims, 1 Drawing Sheet

MAGNETIC SECURITY SYSTEM RESPONSIVE TO PREDETERMINED PERSONS

CROSS-REFERENCE TO RELATED APPLICATION

This application is a continuation-in-part of the copending application Ser. No. 07/871,057 filed Apr. 20, 1992 by Robert R. Bennett et al., now abandoned, which is incorporated herein by reference.

FIELD OF THE INVENTION

This invention relates in general to security systems and in particular to a security system and method of operating such as may be utilized in nursing homes, institutions for the feeble minded and mentally deficient, or other places to either prevent an attempted egress through a preselected door of a resident of such home or institution or to alert the staff thereof of such an attempted egress.

BACKGROUND OF THE INVENTION

In the past, various different systems have been utilized in various different environments, such as nursing homes for the aged, hospital wards, and institutions for the mentally impaired or the like for instance, in an attempt to control the wandering and/or escape from a confining space in such environments of the patient or residents of such environments.

One of the past security systems shown in U.S. Pat. No. 4,555,696 for utilization in the aforementioned environments employed a mat positioned in a passageway, and a plurality of magnetically operated switches within the mat were electrically interconnected with an alarm. Shoes having a magnetic material inner sole were provided for patients or residents of the aforementioned environments, and magnetic material inner soles effected the magnetic operation of the switches when the patient placed his shoe on the mat. The magnetic operation of the switches energized the alarm to sound a warning to the staff of the attempted egress through the passageway of the patient. At least one of the disadvantages or undesirable features of the above discussed past security systems is believed to be that a bare foot patient could step on the mat without magnetically actuating the switches thereby to egress through the passageway without sounding the alarm.

Another of the past security systems shown in U.S. Pat. No. 3,564,501 discloses a microwatt radio transmitter worn by a user for transmitting radio frequency signals to a receiver associated with circuity for unlocking a door through which the user desires to pass as the user approaches the door. One of the disadvantageous or undesirable features of the above discussed security system is believed to be that the receiver may be actuated by various stray or random radio frequency signals thereby to effect random or unwanted unlocking of the door.

In still another past security system shown in U.S. Pat. No. 4,682,155, a small radio transmitter was worn by a patient in one of the aforementioned environments for transmitting radio frequency signals to a receiver associated with a door, and upon receiving such signals, the receiver energized an alarm at a remote station to alert the staff on duty at such remote station that the patient was attempting to egress through the door. At least one of the disadvantageous or undesirable features of this above discussed past security system is believed that the receiver may be actuated by stray radio frequency signals, as mentioned hereinabove.

SUMMARY OF THE INVENTION

Among the several objects of the present invention may be noted the provision of an improved security system and an improved method of operating a security system which overcome at least the disadvantageous or undesirable features discussed above, as well as others, with respect to the prior art; the provision of such improved security system and method in which a current generator establishes a current or signal to initiate the operation of the security system in response to the passage or movement adjacent the current generator of the magnetic field of a permanent magnet secured to a preselected person attempting egress through a door from a space in which the preselected person is confined; the provision of such improved security system and method in which the establishment of the aforementioned current or signal initiates the operation of the security system to energize circuity for locking the door to prevent the egress therethrough of the preselected person or for energizing an audio alarm to sound a warning of such attempted egress through the door of the preselected person; the provision of such improved security system and method in which means are provided for obviating the operation of the security system upon the occurrence of a preselected condition, such as for instance the energization of a fire alarm or the like, thereby to prevent the locking of the door; and the provision of such improved security system and method in which the component parts utilized therein are simplistic in design, economically manufactured and easily assembled. These as well as other objects and advantageous features of the present invention will be in part apparent and in part pointed out hereinafter.

In general, a security system is provided in one form of the invention for operation in response to an attempted egress through a door of at least one preselected person. The security system has a security device associated with the door for energization upon the attempted egress through the door of the at least one person. A permanent magnet having a magnetic field is carried by the at least one person, and means is associated with the door for generating a current in response to the magnetic field of the permanent magnet when it is passed adjacent the generating means by the at least one preselected person upon the attempted egress through the door. Means is operable generally in response to the current generated by said generating means for effecting the energization of the security device.

Further in general and in one form of the invention, a method is provided for operating a security system in response to an attempted egress through a door of at least one preselected person. In this method, the magnetic field of a permanent magnet is passed within a preselected spatial relation adjacent a current generator upon the attempted egress through the door of the at least one preselected person. A current is established in the current generator in response to the passing of the magnetic field adjacent the current generator, and a switching device is switched to one of its switching modes upon the establishment of the current in the current generator. A security device associated with the door is energized in response to the switching of the switching device to its one switching mode.

BRIEF DESCRIPTION OF THE DRAWINGS

Corresponding reference characters indicate corresponding parts throughout the several views of the drawings.

Figure 1:
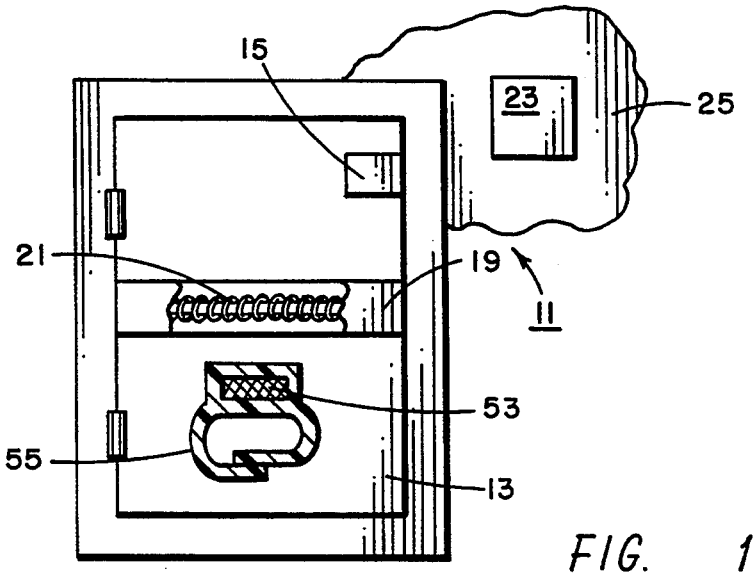
FIG. 1 is a schematic view of a door having a security system in one form of the invention for confining at least one preselected person to a preselected space and illustrating principles which may be practiced in a method of operating such security system also in one form of the invention.

The exemplifications set out herein illustrate the preferred embodiments of the present invention in one form thereof, and such exemplifications are not to be construed as limiting the scope of the invention in any manner.

DETAILED DESCRIPTION OF THE PREFERRED EMBODIMENTS

With reference now to the drawings in detail, there is shown in one form of the invention a security system, indicated generally at 11, associated with a door 13, and the security system is operable generally in response to an attempted egress through the door of only preselected persons intended to be confined to a preselected space or area (not shown) from which the door provides a passageway. The aforementioned preselected persons may be patients or residents of nursing homes for the aged, hospital wards, and institutions for the mentally deficient or feeble minded or the like for instance. Thus, door 13 is normally unlocked to permit the passage therethrough of authorized persons to and from the aforementioned preselected area; however, as discussed in detail hereinafter, security system 11 is operable to automatically lock the door in the event of an attempted egress from the preselected area through the door of at least one of the aforementioned preselected persons, as discussed in greater detail hereinafter.

Mounted to door 13 is a security or locking device 15 of a type well known to the art, such as for instance model number 8011- 003-A available from Rofu International Corp., Newbury Park, Calif., which is actuated by a solenoid 17 (see FIG. 2) and a push bar 19 formed of a non-magnetic material, such as aluminum or a plastic or the like for instance, which encases a magnetic sensor or sensing device 21. Locking device 15 and magnetic sensor 21 carried on door 13 are, of course, component parts of security system 11, and if desired, the other components of the security system may be mounted in a container or box 23 in a convenient location therefor, such as for instance on a wall 25 or ceiling (not shown) adjacent the door. While the circuitry or circuit connections for locking device 11, magnetic sensor 21 and the aforementioned other components of security system 11 are omitted from FIG. 1 for the sake of drawing simplification and brevity of disclosure, such circuitry is discussed hereinafter with respect to FIG. 2.

A circuit 27 for security system 11 is provided with a step-down transformer 29 having high side coils 31 connected across an AC power supply or lines L1, L2 and low side coils 33 connected across an AC-DC converter 35 of a type well known to the art, such as a full bridge rectifier (not shown) or the like for instance. Thus, transformer 21 and AC-DC converter 35 convert the higher voltage (110 volts for instance) AC power of power supply L1, L2 to a lower voltage (12 volts for instance) DC power which appears across a pair of output terminals 37, 39 of the AC-DC converter.

A switching means or device, such as a gate turnon device (GTO) 41 or the like for instance, is serially connected with solenoid or solenoid means 17 of locking device 15, and both the GTO and the solenoid are connected in parallel across output terminals 37, 39 of AC-DC converter 35. A logic circuit 43 of a type well known to the art, such as a monostable multi-vibrator or the like for instance, has its power supply or input terminals connected in parallel across the serially arranged solenoid 17 and GTO 41 as well as output terminals 37, 39 of AC-DC converter 35, and an operational amplifier circuit 45 has its power supply or input terminals connected in parallel across the output terminals of the AC-DC converter. Logic circuit 43 may be essentially a switching device drive circuit and a timer (not shown), as is well known in the art, and the output of the logic circuit is interconnected in gating relation with the gate of GTO 41. Operational amplifier circuit 45 has its output connected with the input of logic circuit 43, and the operational amplifier circuit may be of a type well known in the art, such as that shown on page 343 of the IC Op-Amp Cook Book, 3rd Edition (1992) published by Sams, a division of Prentise Hall Computer Publishing, Carmel, Ind. While operational amplifier circuit 45 is shown herein for purposes of disclosure, it is contemplated that various other amplifier circuits well known in the art may be utilized in circuit 27 of security system 11 in the place of operational amplifier circuit 45 within the scope of the invention so as to meet at least some of the objects thereof.

Magnetic sensor 21 has a core or stator 47 formed of a ferromagnetic material, and a winding means, such as a coil 49 of an electrical conductive material or the like for instance, is disposed about the core, and the coil is connected across the inverting and non-inverting inputs of operational amplifier circuit 45. To complete the description of circuit 27 for security system 11, a means, such as for instance a normally closed relay 51 or the like, is operably connected in the circuit for disabling it to obviate the operations of solenoid 17, GTO 41 logic circuit 43 and operational amplifier circuit 45 in the event of the occurrence of a preselected condition, such as for instance the energization of a fire alarm or the like.

In the operation of security system 11, a permanent magnet or magnet means, such as a neodymium magnet 53 or the like for instance, is carried or encased in a band or bracelet 55 formed of a non-magnetic metallic material or a plastic or the like for instance, as shown in FIG. 1, which may be releasably secured against displacement to the wrist of the aforementioned preselected person intended to be confined in the preselected area (not shown) to which door 13 is a passageway.

As previously mentioned, door 13 is normally unlocked to permit ingress and egress of authorized persons through the door to the preselected or confining area for the preselected persons. When a preselected person wearing bracelet 55 containing magnet 53 attempts to egress through door 13 from the confining area for such preselected person, the preselected person approaches push bar 19 on the door in which magnetic sensor 21 is encased, and the magnetic field (not shown)

of the magnet is passed or otherwise moved within a preselected range or spatial relation with respect to coils 49 of the magnetic sensor. As magnet 53 is moved adjacent magnetic sensor 21, the lines of flux in the magnetic field of the magnet cut coils 49 of the magnetic sensor to generate or establish a rather low current or signal in the coils of the magnetic sensor; therefor, the magnetic sensor defines a means for generating a current in response to the magnetic field of the magnet when it is passed adjacent the magnetic sensor upon the attempted egress by the preselected person through door 13. Of course, the aforementioned preselected spatial relation of magnet 53 with respect to coils 49 of magnetic sensor 21 may be altered by varying the number of turns in the coils.

Figure 2:
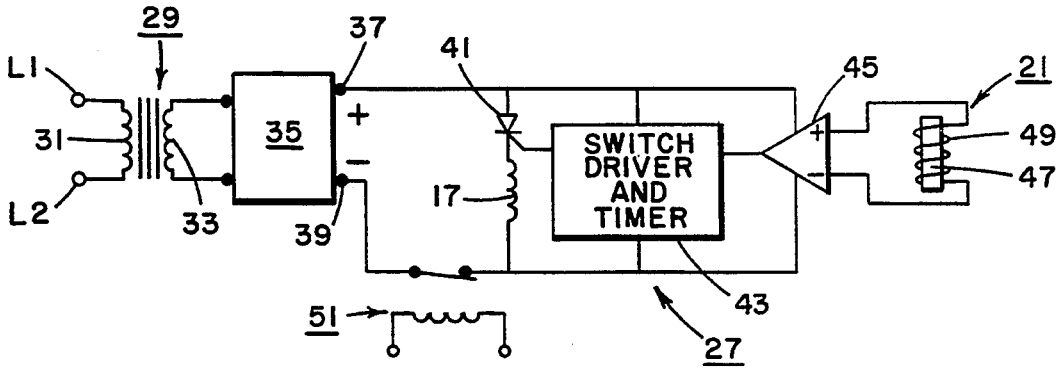
FIG. 2 is a diagrammatic view illustrating a circuit diagram for the security system of FIG. 1.

Operational amplifier circuit 45 amplifies the aforementioned rather low generated current supplied thereto to produce a signal of sufficient amplitude to trigger logic circuit 43, FIG. 2, and when so triggered, the logic circuit provides a gating pulse to enable the conduction of GTO 41. When so gated, GTO 41 becomes conductive to pass current to solenoid 17 effecting its energization which causes the operation of locking device 15 to lock door 13 thereby to prevent the attempted egress through he door of the preselected person. It may be noted that GTO 41, logic circuit 43 and operational amplifier circuit 45 define a means operable generally in response to the current generated by generating means or magnetic sensor 21 for effecting the energization of locking or security device 15.

When the preselected person moves away from door 13 subsequent to the above discussed attempted egress through the door, magnet 53 in bracelet 55 worn by the preselected person is moved beyond the aforementioned preselected spatial relation with respect to magnetic sensor 21; therefore, the generated current in coils 29 decays so as to be eliminated across the inverting and non-inverting inputs of operational amplifier circuit 45 thereby to effect its deenergization. Of course, when operational amplifier circuit 45 is deenergized, it no longer triggers logic circuit 43; however, since the logic circuit has a switch device drive circuit with a timer, as previously mentioned, the logic circuit means remains operative for a predetermined period of time and thereafter provide an inverted signal to the gate of GTO 41 to disable or turn off the GTO. Upon its disablement, GTO 41 becomes nonconductive thereby to interrupt current flow to solenoid 17 effecting its deenergization which causes the operation of locking device 15 to unlock door 13.

While GTO 41 and logic device 43 are shown in circuit 27 of security system 11 for the purpose of disclosure, it is contemplated that various other switching devices, including for instance a low current mechanical relay or the like, and logic circuits may be employed in the security system circuit in place of GTO 41 and logic circuit 43 within the scope of the invention so as to meet at least some of the objects thereof. For instance, it is contemplated that a micro-processor and some form of a drive device for GTO 41 may be employed in security system circuit 27 in place of logic circuit 43 within the scope of the invention so as to meet at least some of the objects thereof.

Figure 3:
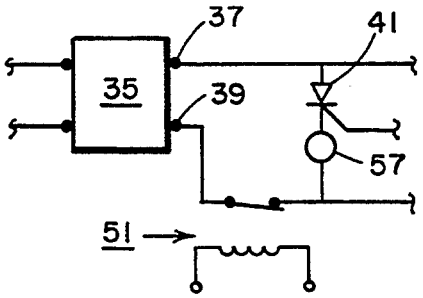
FIG. 3 is a partial diagrammatic view illustrating an alternative circuit diagram for the security system of FIG. 1.

With reference now to FIG. 3, another security device, such as an audio alarm 57 or the like for instance, is shown connected in circuit 27 of security system 11 to replace locking device 15 and its solenoid 17. When GTO 41 is gated to become conductive in the manner discussed hereinabove, audio alarm 57 is energized to sound an alarm that the preselected person is attempting to egress through door 11 from the preselected space in which the preselected person in intended to be confined. Of course, when audio alarm 57 is employed in circuit 27 of security system 11, door 13 is unlocked.

From the foregoing, it is now apparent that a novel security system and a novel method of operating such are provided meeting the objects and advantageous features set out hereinabove, as well as others, and that modifications or changes as to the precise configurations, details and connections of the components of such security system, as well as the steps of such method and the precise order thereof, may be made by those having ordinary skill in the art without departing from the spirit of the invention or the scope thereof as defined by the claims which follow.

We claim:

1. A security system for operation in response to an attempted egress through a door of at least one preselected person, the security system comprising:

a security device associated with the door for energization upon the attempted egress through the door of the at least one preselected person;

a permanent magnet having a magnetic field and carried by the at least one preselected person;

means associated with the door for generating a current in response to the magnetic field of said permanent magnet when it is passed adjacent said generating means by the at least one preselected person upon the attempted egress through the door; and means operable generally in response to the current generated by said generating means for effecting the energization of said security device.

2. The security system as set forth in claim 1 wherein said security device comprises a locking device operable for locking the door to prevent the egress therethrough of the at least one preselected person, said locking device including solenoid means energized upon the operation of said energization effecting means for effecting the locking of the door by said locking device.

3. The security system as set forth in claim 1 wherein said security device comprises audio alarm means energized in response to the operation of said energization effecting means for sounding an alarm to warn of the attempted egress through the door of the at least one preselected person.

4. The security system as set forth in claim 1 wherein said generating means includes a magnetic material core, and a plurality of winding means associated with said core for connection in circuit relation with said energization effecting means, the magnetic field of said permanent magnet coacting with said magnetic material core to generate the current in said winding means.

5. The security system as set forth in claim 1 wherein said energization effecting means includes a switching device operable generally between a plurality of switching modes for controlling said security device, a logic circuit arranged to drive said switching device, and an operational amplifier circuit operable in response to the current generated by said generating means for tripping said logic circuit to drive said switching device to one of its switching modes effecting the energization of said security device.

6. The security system as set forth in claim 5 wherein said logic circuit includes a switching device drive circuit with a timer.

7. The security system as set forth in claim 1 including means for supplying DC power connected in parallel circuit relation with at least said switching device and said security device.

8. The security system as set forth in claim 1 further comprising means operable in response to a preselected condition for obviating the operation of the security system.

9. A method of operating a security system in response to an attempted egress through a door of at least one preselected person, the security system including a permanent magnet having a magnetic field and carried by the at least one preselected person, a security device for the door, a current generator, and a switching device having a plurality of switching modes, the method comprising the steps of:

passing the magnetic field of the permanent magnet within a preselected spatial relation adjacent the current generator upon the attempted egress through the door by the at least one preselected person;

establishing a current in the current generator in response to the passing step;

switching the switching device to one of its switching modes upon the establishment of the current in the current generator; and effecting the energization of the security device in response to the switching step.

10. The method as set forth in claim 9 wherein the security system further includes an operational amplifier circuit and a logic circuit and wherein the method further comprises the intermediate steps of energizing the operational amplifier circuit in response to the current established during the establishing step, producing a signal of sufficient amplitude to trigger the logic circuit in response to the energizing step, and driving the switching device to effect the switching step in response to the triggering of the logic circuit.

11. The method as set forth in claim 9 wherein the security device comprises a solenoid operated lock and wherein the effecting step includes energizing the solenoid and operating the lock in response to the energization of the solenoid to lock the door thereby to prevent the attempted egress through the door of the at least one preselected person.

12. The method as set forth in claim 9 wherein the security device comprises an audio alarm and wherein the effecting step includes energizing the audio alarm to sound a warning of the attempted egress through the door of the at least one preselected person.

13. The method as set forth in claim 9 wherein the security system further includes a relay device and wherein the method further comprises the additional steps of energizing the relay device in response to the occurrence of a preselected condition and obviating the occurrence of at least the effecting step in response to the energizing step.

* * * * *